US005718521A

United States Patent [19]

Koo

[11] Patent Number: 5,718,521

[45] Date of Patent: Feb. 17, 1998

[54] PRINTER FOR ONE TIME PRINTING A PICTURE AND TEXT

[75] Inventor: Sang-heon Koo, Seoul, Rep. of Korea

[73] Assignee: Samsung Electronics Co., Ltd., Kyungki-Do, Rep. of Korea

[21] Appl. No.: 699,065

[22] Filed: Aug. 15, 1996

[30] Foreign Application Priority Data

Dec. 30, 1995 [KR] Rep. of Korea ..... 95-69761

[51] Int. Cl.[6] ..... B41J 2/32

[52] U.S. Cl. ..... 400/120.02; 101/211; 101/490; 347/214; 347/174; 400/248

[58] Field of Search ..... 101/483, 487, 101/490, 211; 400/240, 240.1, 240.2, 240.3, 240.4, 248, 208, 208.1, 120.02, 624, 408, 248.3; 347/172, 174, 171, 214

[56] References Cited

U.S. PATENT DOCUMENTS 4,888,601 12/1989 Inui ..... 101/487
5,249,873 10/1993 Okunomiya et al. ..... 347/214
5,326,184 7/1994 Shibata ..... 400/624
5,442,449 8/1995 Stemmle et al. ..... 347/214
5,499,093 3/1996 Aerens et al. ..... 101/211
5,611,629 3/1997 Paranjpe ..... 400/120.02

FOREIGN PATENT DOCUMENTS 43224750 10/1991 Japan ..... 347/174

*Primary Examiner*—Eugene H. Eickholt
*Attorney, Agent, or Firm*—Sughrue, Mion, Zinn, Macpeak & Seas, PLLC

[57] ABSTRACT

A printer capable of continuously and sequentially performing the printing of a picture and a text includes a picture printing device for printing an image and a text printing device for printing text. The picture printing device includes an ink sheet and a recording head to print the image by overlaying sublimed color inks. The text printing device may take the form of an ink-jet printer including a head having nozzles for ejecting the ink by means of the pressure of bubbles. Alternatively, the text printing device may take the form of a laser printer.

4 Claims, 4 Drawing Sheets

PRINTER FOR ONE TIME PRINTING A PICTURE AND TEXT

BACKGROUND OF THE INVENTION

The present invention relates to a printer and, more particularly, to an improved printer capable of continuously and sequentially printing a picture and text.

In general, there are a sublimation-type thermal transfer printer, an ink-jet printer and a laser printer.

The sublimation-type thermal transfer printer includes an ink sheet having a surface which is sequentially coated with yellow, magenta, cyan and black in general, a heating head for heat-pressing the ink sheet according to a predetermined recording signal, and rollers for guiding a paper while each color of the ink sheet is sequentially printed in a superimposed manner.

The ink-jet printer includes a reservoir for containing ink, a head comprising a plurality of nozzles for ejecting the ink provided from the reservoir, and an ejecting means for ejecting the ink through each nozzle to a paper.

The laser printer includes a laser diode for radiating light, a polygonal rotating mirror for reflecting the light radiated from the laser diode, a photosensitive drum of which a predetermined portion is exposed to the light, a developing unit for developing a surface of the photosensitive drum with developing material, and a transferring unit for transferring the developed image of the developing material on the photosensitive drum to a paper.

Meanwhile, when ID cards or credit cards bearing both text and picture images are manufactured, the text image is primarily printed on a paper by means of one of the above-mentioned printers and then the picture is cut and pasted on the text printed paper. Accordingly, in printing the ID or credit card using the above printers, it has been burdensome in that the picture must be additionally attached after the text is printed.

SUMMARY OF THE INVENTION

To solve the above problems, it is an object of the present invention to provide an improved printer capable of one time printing a picture and a text.

Accordingly, to achieve the above object, there is provided a printer operative to continuously and sequentially print a picture and a text, comprising: picture printing means for printing a picture image, which includes a cylindrical platen drum, a cartridge installed at one side of said platen drum and containing an ink sheet on which inks of various colors are surface-sequentially coated, paper feeding means for feeding a paper between said platen drum and the ink sheet, and a recording head for subliming the inks of the ink sheet onto a portion of the paper by heat-pressing the ink sheet according to a predetermined recording signal; and text printing means for printing a text, which includes a reservoir for containing an ink, a recording head having an ink ejection device including a plurality of nozzles for ejecting the ink supplied from said reservoir according to a predetermined recording signal.

According to another aspect of the present invention, there is provided a printer operative to continuously and sequentially print a picture and a text, comprising: picture printing means for printing a picture image, which includes a cylindrical platen drum, a cartridge installed at one side of said platen drum and containing an ink sheet on which inks of various colors are surface-sequentially coated, paper feeding means for feeding a paper between said platen drum and the ink sheet, and a recording head for subliming the inks of the ink sheet onto a portion of the paper by heat-pressing the ink sheet according to a predetermined recording signal; and text printing means for printing a text, which includes a photosensitive drum having a surface on which a photoconductive film is formed, a charger for charging the surface of said photosensitive drum to obtain a charged photosensitive drum, a laser diode for radiating light to the surface of said charged photosensitive drum, a developing unit for developing the surface of said photosensitive drum with a developing material to form a developed image, and a transferring unit for transferring the developed image of the developing material on said photosensitive drum to the paper.

BRIEF DESCRIPTION OF THE DRAWINGS

The above object and advantages of the present invention will become more apparent by describing in detail preferred embodiments thereof with reference to the accompanying drawings, in which.

DETAILED DESCRIPTION OF THE PREFERRED EMBODIMENTS

Figure 1:
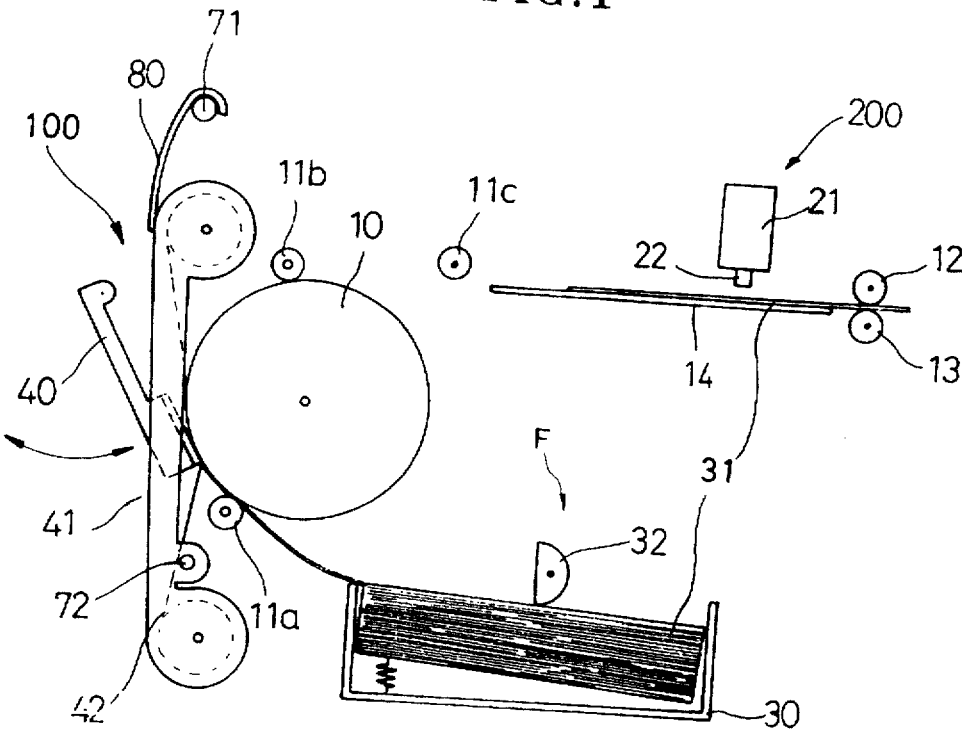
FIG. 1 is a schematic view illustrating an embodiment of a printer according to the present invention.

FIG. 1 shows a first embodiment of a printer according to the present invention. The printer includes a picture printing means 100 for printing images such as graphics on a portion of a sheet of paper 31 and a text printing means 200 for printing a text on the other portion of the sheet of paper 31. In this printer, the picture is first printed by the picture printing means 100, and then the text is printed by the text printing means 200.

The picture printing means 100 comprises a cylindrical platen drum 10, a cartridge 41 installed at one side of the platen drum 10 and containing an ink sheet 42 where inks of various colors are surface-sequentially coated, paper feeding means F for feeding the paper 31 between the platen drum 10 and the ink sheet 42, and a recording head 40 for subliming the ink of the ink sheet 42 by heat-pressing the ink sheet 42 according to a predetermined recording signal and making the sublimed ink absorb onto a portion of the sheet of paper 31. The recording head 40 can be rotated by means of a predetermined driving means and be released from the cartridge 41.

Figure 4:
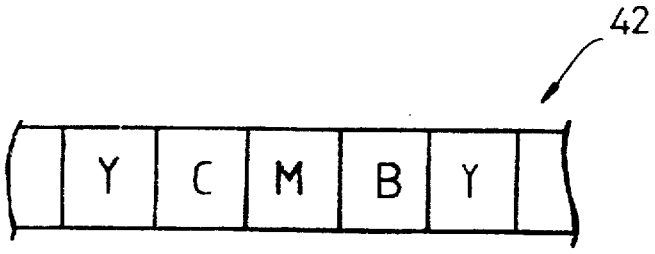
FIG. 4 is a schematic view illustrating an ink sheet.

In the ink sheet 42, color inks of yellow (Y), cyan (C), magenta (M) and black (B) are surface-sequentially formed, as shown in FIG. 4.

The paper feeding means F comprises a paper supply cassette 30 where a plurality of sheets of paper 31 are stacked, and a semicircular cam 32 for transferring a sheet of paper 31 on top of the paper stack contained in the paper supply cassette 30 toward the platen drum 10. The semicircular cam 32 is rotatably driven by means of a predetermined driving means. At the platen drum 10, guide rollers 11*a*, 11*b* and 11*c* for guiding the paper 31, are installed.

The text printing means 200 for printing text on the paper 31 ejected from the platen drum 10 is provided at one side of the platen drum 10.

In this embodiment, an ink-jet printer is employed for the text printing means 200, which comprises a reservoir 21 for containing ink, a recording head 22 having an ink ejection device including a plurality of nozzles for ejecting the ink supplied from the reservoir 21 according to a predetermined recording signal. The ink ejection device is provided with a heating member (not shown) for heating the ink, and thus, the ink is ejected through the nozzles due to the pressure of bubbles occurring during the heating.

Figure 7:
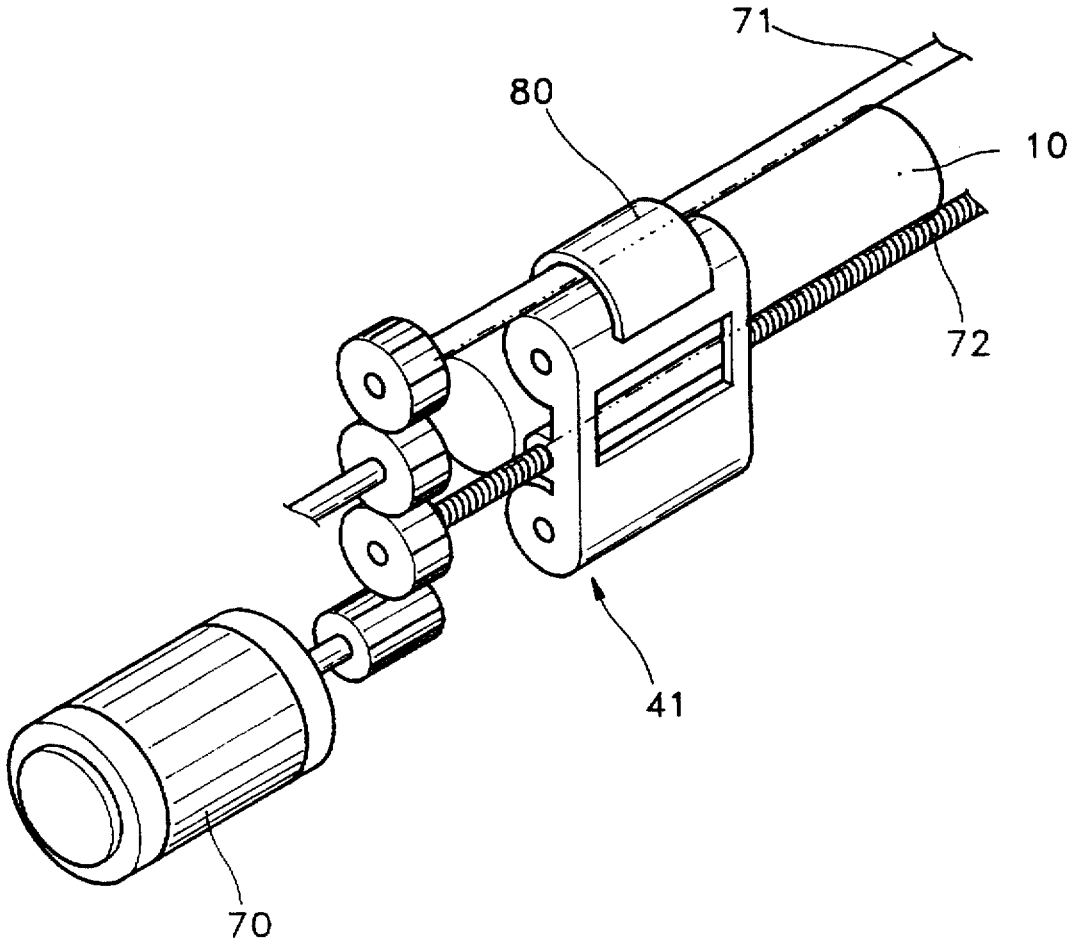
FIG. 7 is a schematic view illustrating a transfer means of a printer according to the present invention, for transferring a cartridge.

Also, a transfer means for transferring the cartridge 41 from one side of the platen drum 10 to the other side thereof is provided in the present printer. Referring to FIGS. 1 and 7, the transfer means comprises a guide rod 71 installed in parallel with a rotation axis of the platen drum 10 and coupled with the cartridge 41 by a support piece 80, for guiding the sliding of the cartridge 41, a screw shaft 72 installed in parallel with the guide rod 71 and screw-coupled with the cartridge 41, and a driving motor 70 for rotating the screw shaft 72. The support piece 80 connected with the cartridge 41 is hung on the guide rod 71 so as to be capable of sliding. Accordingly, the cartridge 41 driven by the driving motor 70 can be moved in a direction of the rotation axis of the platen drum 10. The transfer means is for selectively moving the cartridge 41 according to a position of a picture print portion 31*a* on the paper 31, as shown in FIGS. 3A and 3B.

The operation of the printer having such a structure according to the present invention will now be described.

Figure 3A:
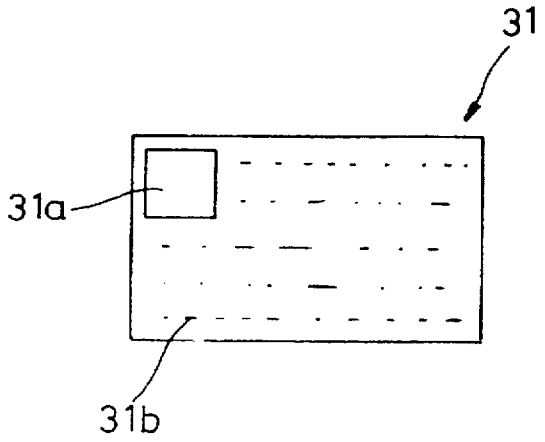
FIGS. 3A and 3B are plan views showing positions of a printed text and a picture on a sheet of paper.
Figure 3B:
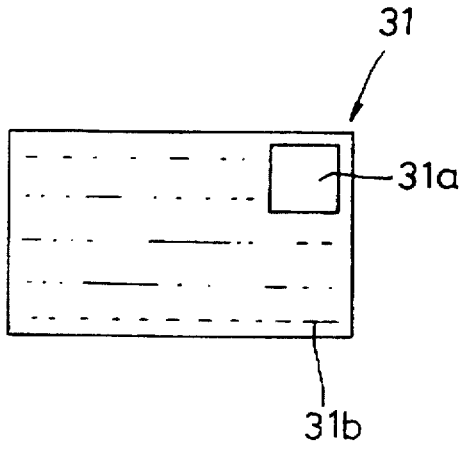

Referring to FIGS. 1, 3 and 4, a sheet of paper 31 in the paper supply cassette 30 is transferred by the semicircular cam 32 toward the platen drum 10, while being closely pressed to the platen drum 10 by the guide roller 11*a*. Then, the recording head 40 is rotated toward the platen drum 10 to heat-press the ink sheet 42 according to a predetermined recording signal. At this stage, yellow (Y) (see FIG. 4) is printed on the picture print portion 31*a* of the paper 31, shown in FIG. 3A. After the printing of the yellow (Y) is completed, both the platen drum 10 and the guide roller 11*a* reversely rotate until the yellow (Y) printed paper is returned to an initial position before printing. During the back transfer of the paper 31, the recording head 40 is rotated to be released and a cyan (C) portion (FIG. 4) is placed at the printing position by winding the ink sheet 42 in one direction. In this state, the platen drum 10 and the guide roller 11*a* rotate again in the original direction, and thus, the paper 31 is re-fed. Subsequently, the recording head 40 is rotated back and heat-presses the ink sheet 42 to print the cyan (C) onto the yellow (Y) printed paper 31.

When the cyan (C) printing is completed, magenta (M) and black (B) printing are each carried out in the same manner. Accordingly, each color is printed to be overlaid with each other at the picture print portion 31*a* on the paper 31.

After the printing at the picture print portion 31*a* is completed, the paper 31 is transferred by the guide roller 11*b* and 11*c* toward the text print means 200, i.e., the ink-jet printer, while guided by a guide plate 14. At this stage, the ink is ejected to a text print portion 31*b* of FIG. 3A and a text is printed. Then, the paper 31 is ejected through transfer rollers 12 and 13.

In the meantime, when the picture print portion 31*a* is disposed at the right side of the paper 31 as shown in FIG. 3B, the cartridge 41 driven by the driving motor 70 is moved to the corresponding right side of the platen drum 10. Then, the picture and text are sequentially printed on the paper 31 in the above-described process.

Figure 5:
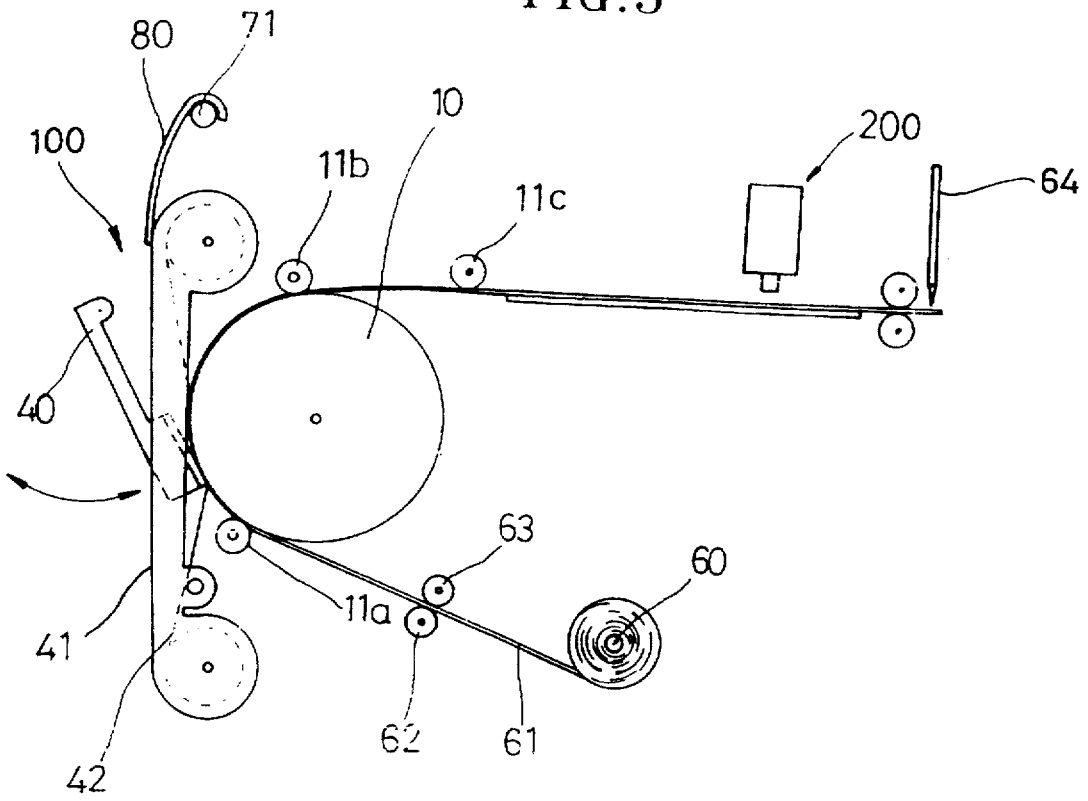
FIGS. 5 and 6 are schematic views illustrating yet another embodiment of a printer according to the present invention.

As shown in FIG. 5, showing a second embodiment of a printer according to the present invention, a paper feeding means comprises a roll 60 where a web of paper 61 is continuously wound, and a pair of rollers 62 and 63 for press-transferring the paper 61. When the roll 60 is employed as above, it is preferred to further adopt a cutter 64 for cutting the paper 61 after the picture printing and text printing have been completed. In this embodiment, the picture printing and text printing are performed following the above sequence.

Figure 2:
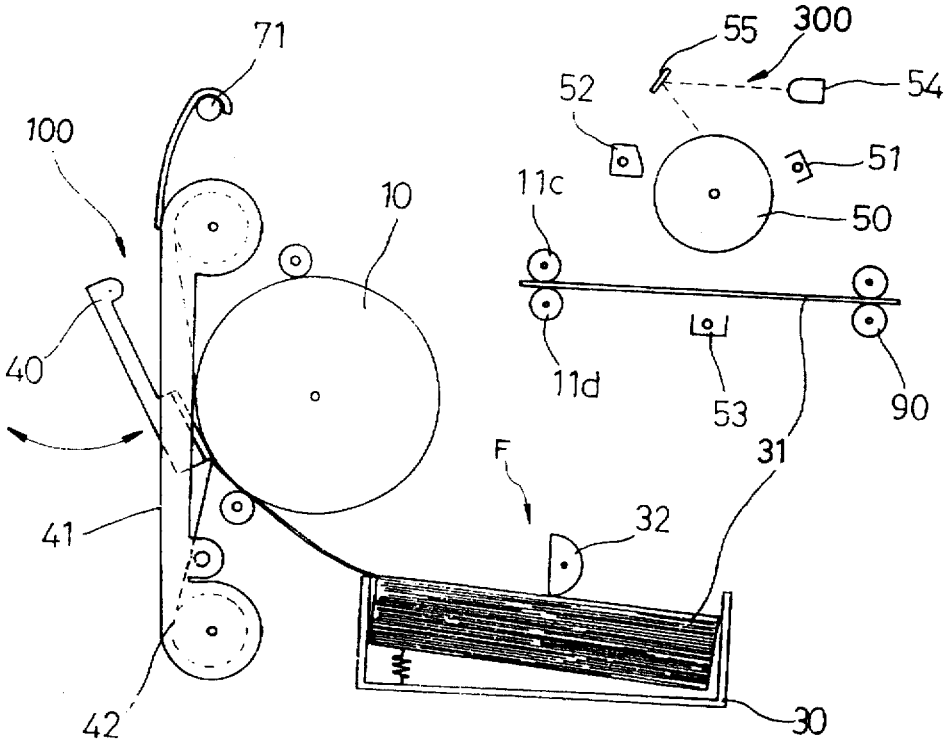
FIG. 2 is a schematic view illustrating another embodiment of a printer according to the present invention.

FIG. 2, wherein components corresponding to those shown in FIG. 1 are designated by the same reference numerals, shows a third embodiment of a printer according to the present invention. Referring to FIG. 2, a text printing means 300 comprises a photosensitive drum 50 on whose surface a photoconductive film is formed, a charger 51 for charging the surface of the photosensitive drum 50, a laser diode 54 for radiating light to the surface of the charged photosensitive drum 50, a developing unit 52 for developing the surface of the photosensitive drum 50 with a developing material, and a transferring unit 53 for transferring the developed image of the developing material onto the paper 31.

In the printer of this embodiment, the operation of the picture printing means 100 will be omitted since the operation is the same as that of the picture printing means 100 of FIG. 1. In the operation of the text printing means 300, the paper 31, which has a picture printed thereon, is transferred by means of the guide roller 11*c* and a transfer roller 11*d* toward the text printing means 300. At this stage, a surface of the photosensitive drum 50 is charged by the charger 51. Light is radiated from the laser diode 54 and the light arrives on the surface of the photosensitive drum 50 via a reflection mirror 55. At this time, an electrostatic latent image is formed on the surface of the photosensitive drum 50. Next, a developing material is coated from the developing unit 52 on the electrostatic latent image of the photosensitive drum 50. Then, the developing material coated on the photosensitive drum 50 is transferred by the transferring unit 53 to the text print portion 31*b* (see FIGS. 3A and 3B) of the paper 31, thereby absorbing onto the surface of the paper 31. The developing material transferred to the paper 31 is fixed through a pair of fixing rollers 90.

Figure 6:
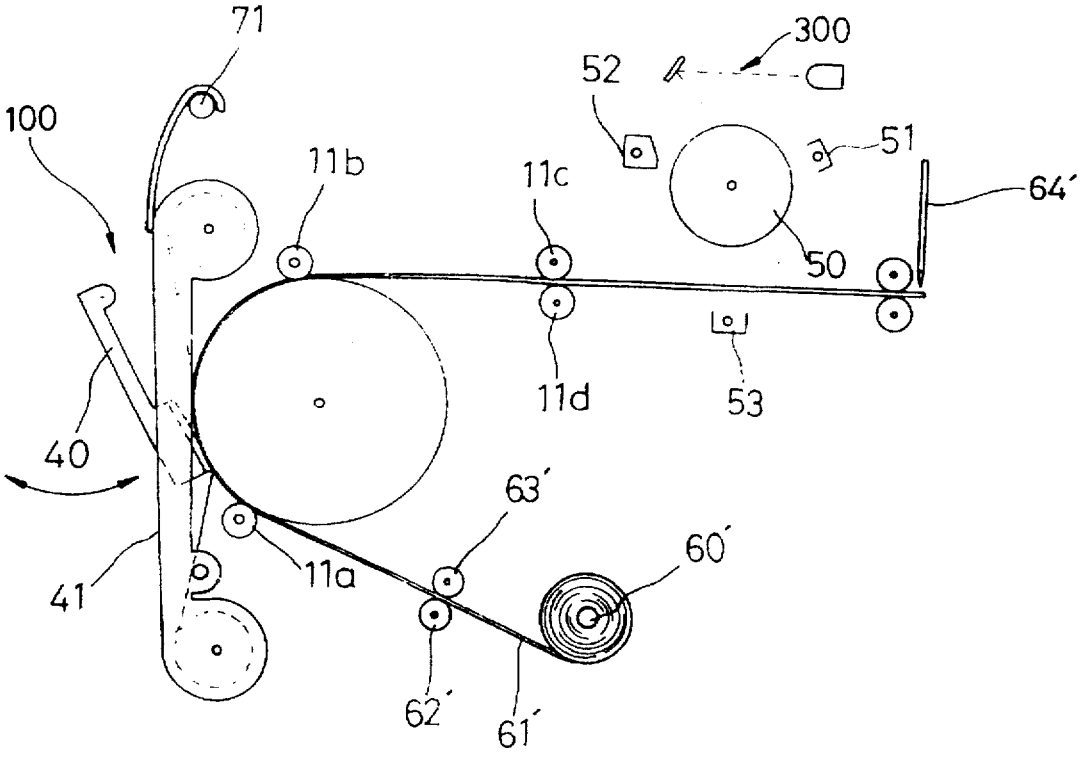

Referring to FIG. 6, showing a fourth embodiment of a printer according to the present invention, wherein the identical elements consequently bear the same reference numerals given in FIG. 2, a roll 60' where a web of paper 61' is continuously wound and transfer rollers 62' and 63' for transferring the paper 61' are employed as a paper feeding means. Also, a cutter 64' for cutting the paper 61' is further provided. The operation of the printer of this embodiment is the same as that of the printer shown in FIG. 2 except that the paper 61' needs to be cut.

As described above, the printer according to the present invention is capable of continuously printing both a picture and text information.

It is noted that the present invention is not limited to the preferred embodiment described above, and it is apparent that variations and modifications by those skilled in the art can be effected within the spirit and scope of the present invention as defined in the appended claims.

What is claimed is:

1. A printer operative to continuously and sequentially print a picture and a text, comprising:

picture printing means for printing a picture image, including a cylindrical platen drum, a cartridge installed at one side of said platen drum and containing an ink sheet on which inks of various colors are surface-sequentially coated, paper feeding means for feeding a paper between said platen drum and the ink sheet, and a recording head for subliming the inks of the ink sheet onto a portion of the paper by heat-pressing the ink sheet according to a predetermined recording signal; said printer further comprising:

text printing means for printing a text, including a photosensitive drum having a surface on which a photoconductive film is formed, a charger for charging the surface of said photosensitive drum to obtain a charged photosensitive drum, a laser diode for radiating light to the surface of said charged photosensitive drum, a developing unit for developing the surface of said photosensitive drum with a developing material to form a developed image, and a transferring unit for transferring the developed image of the developing material on said photosensitive drum to the paper; wherein said transferring unit selectively transfers said cartridge in a lateral direction from one side of said platen drum to another side thereof according to a predetermined position of a picture print portion on the paper.

2. The printer as claimed in claim 1, wherein said paper feeding means comprises:

a paper supply cassette where a plurality of sheets of paper are stacked; and a semicircular cam for transferring an individual sheet of paper on top of the stack of papers contained in said paper supply cassette toward said platen drum.

3. The printer as claimed in claim 1, wherein said paper feeding means comprises:

a roll on which a web of the paper is continuously wound; and a pair of rollers for press-transferring the paper.

4. The printer as claimed in claim 1, wherein said transfer means comprises:

a guide rod coupled with a portion of said cartridge and for slidably guiding said cartridge;

a screw shaft installed in parallel with said guide rod and screw-coupled with said cartridge; and a driving motor for rotating said screw shaft.

* * * * *